United States Patent [19]

Peers-Trevarton

[11] 4,169,974

[45] Oct. 2, 1979

[54] PUSH OPERATED MOMENTARY SWITCH

[75] Inventor: Charles A. Peers-Trevarton, Coral Springs, Fla.

[73] Assignee: AMF Incorporated, White Plains, N.Y.

[21] Appl. No.: 891,785

[22] Filed: Mar. 30, 1978

[51] Int. Cl.[2] ..... H01H 1/06

[52] U.S. Cl. ..... 200/276; 200/159 A; 200/76

[58] Field of Search ..... 200/153 J, 153 SC, 159 R, 200/276, 159 A, 160, 154, 76, 77

[56] References Cited

U.S. PATENT DOCUMENTS

| | | | |
|---|---|---|---|
| 3,773,996 | 11/1973 | Sharf | 200/276 |
| 3,902,032 | 8/1975 | Koepke | 200/159 A |
| 3,920,943 | 11/1975 | Lapointe | 200/276 |
| 4,016,388 | 4/1977 | Golbeck et al. | 200/159 A |
| 4,092,503 | 5/1978 | Raeder | 200/276 |

FOREIGN PATENT DOCUMENTS

| | | | |
|---|---|---|---|
| 810597 | 8/1951 | Fed. Rep. of Germany | 200/276 |

*Primary Examiner*—Joseph Man-Fu Moy
*Attorney, Agent, or Firm*—George W. Price; John H. Gallagher

[57] ABSTRACT

A momentary push button switch having a helical spring contact with tangentially extending opposite ends. The spring is seated over a vertical post on a base member and the lower tangential end of the spring permanently engages one stationary contact in the base. The upper tangential end of the spring contact selectively engages a horizontal arm of a second stationary contact on the base.

A plunger (push button) fits over the vertical post and engages the top end of the helical spring. A keyway on the plunger slidingly engages a guide post on the base. Depression of the plunger disengages the upper tangential end of the spring from the arm of the second stationary contact.

Two alternative embodiments for normally open switch configurations are disclosed.

15 Claims, 5 Drawing Figures

PUSH OPERATED MOMENTARY SWITCH

This invention relates to a type of electrical switch that may be normally closed or normally open and which has a plunger that is depressed to change the conducting condition of the switch. The switch may be made in either a normally open or a normally closed configuration by using one or the other of two spring contacts whose shapes are slightly different. Thus, the two embodiments employ an optimum number of common parts, and a minimum of tooling and expense is required to be able to produce normally closed and normally open switches. Additionally, pretravel and overtravel of the plunger before and after the contacts change switching conditions may be changed with a minimum of physical change to the basic design.

The invention will be described by referring to the accompanying drawings wherein.

Figure 1:
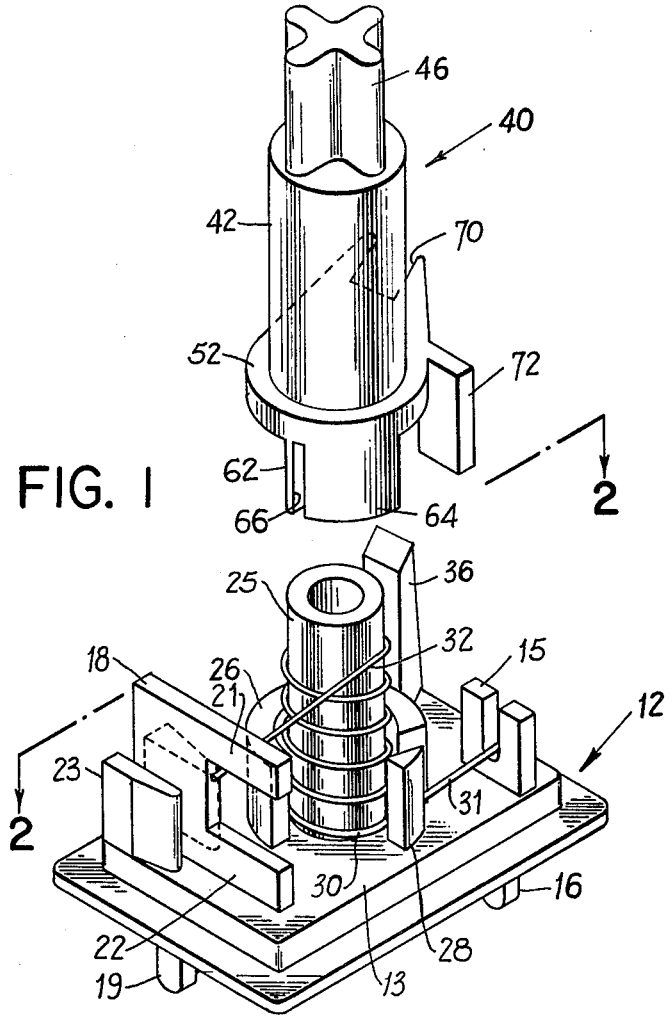
FIG. 1 is a perspective view of the working portions of a normally closed embodiment of the switch of this invention.
Figure 4:
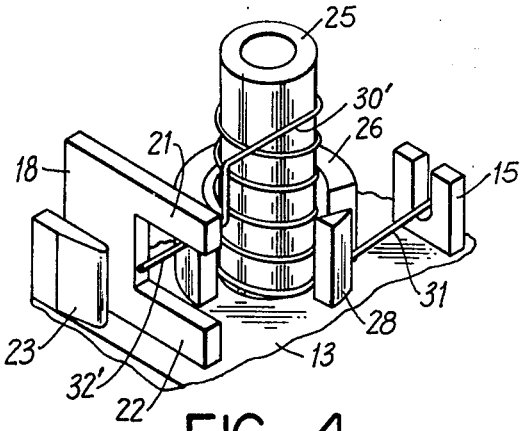
Figure 5:
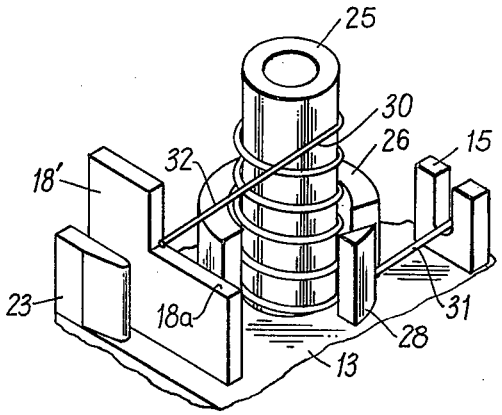

FIG. 4 is a perspective view of a portion of the base and the spring contact member, and showing a differently shaped spring contact member that provides a normally open switch configuration; and FIG. 5 is an illustration of a portion of the base and the spring contact member of FIG. 1, and illustrating a differently shaped stationary contact for use in producing a normally open switch configuration.

Figure 2:
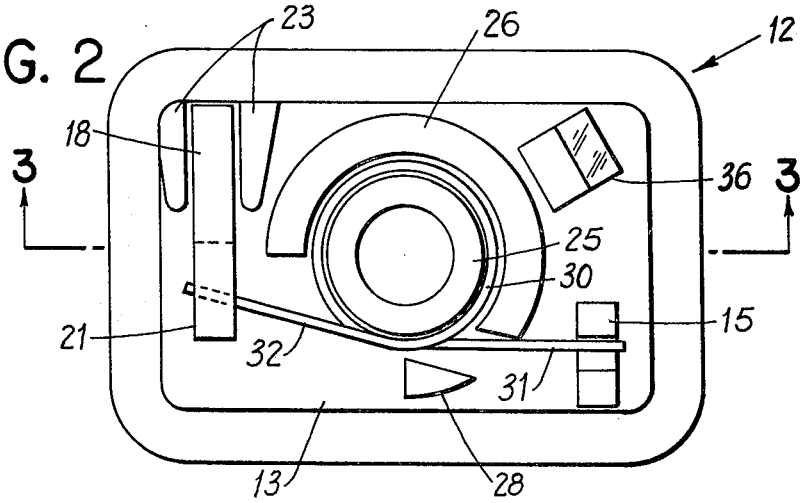
FIG. 2 is a plan view of the base portion of the switch, taken at section 2—2 of FIG. 1.
Figure 3:
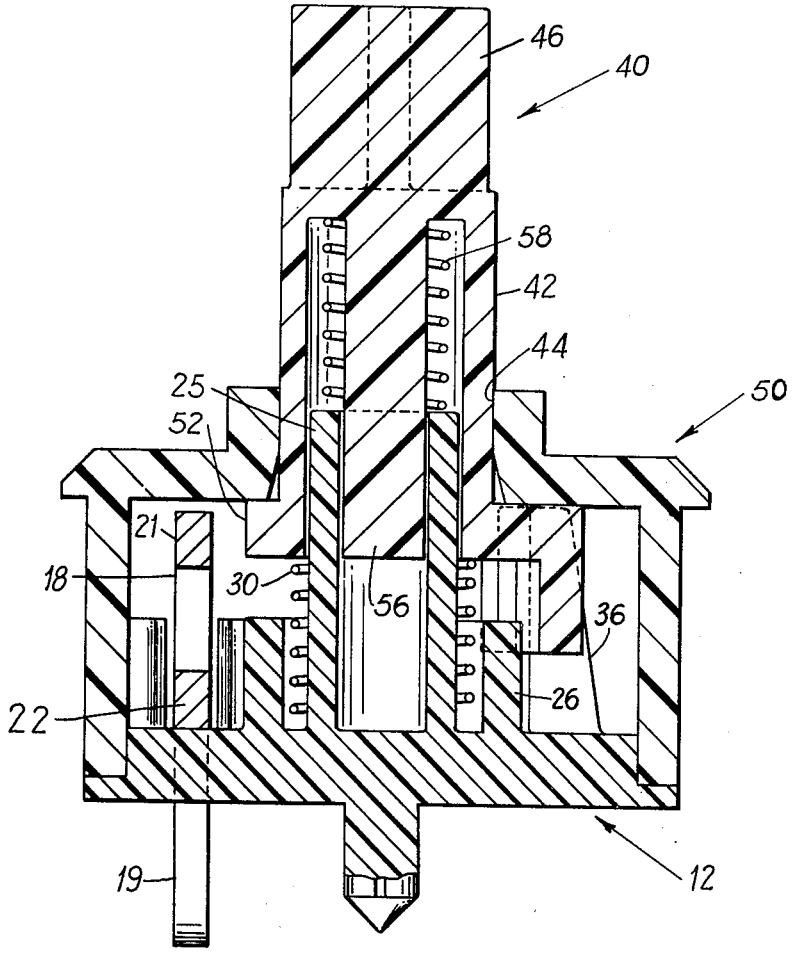
FIG. 3 is a side elevation view, in section, of a switch of this invention.

Referring now in detail to FIGS. 1, 2 and 3, the switch includes a base member 12 of molded plastic material that has a flat raised portion 13 over most of its surface, except for the edge regions. A first stationary contact 15 located adjacent one corner of the raised portion 13 has a U-shaped upper portion and a lower terminal portion 16 that extends through the base 12 to the other side. A second stationary contact 18 located adjacent the diagonally opposite corner has a terminal 19 that extends through base 12 to the other side. The portion of stationary contact 18 that is above the base 12 has two vertically spaced, horizontally extending arms 21 and 22. Two integrally molded tabs 23 on opposite sides of contact 18 serve as lateral supports for the contact and aid in the correct assembly of the device since an assembler cannot readily insert the smaller stationary contact 15 between the tabs 23 and into an aperture passing through base member 12.

A molded stud 17 extends downwardly from the bottom of base 12 and serves as a guide and support that is inserted into an aperture in a printed circuit board.

A hollow cylindrical post 25 is molded as a part of base 12 and extends upwardly from the central region of the base. An upwardly extending integrally molded semicircular guide 26 is disposed in spaced relationship to the back portion of post 25. A molded pie-shaped guide post 28 is disposed in spaced relationship to the front portion of post 25.

A helical spring contact member 30 fits over post 25 and has opposite ends 31 and 32 that extend generally tangentially in opposite directions from its helical body. The bottom end of the helical portion of spring 30 is seated between post 25 and semicircular guide 26. The lower tangentially extending end 31 passes through a slot formed by the right end of guide 26 and the pie-shaped guide 28. End 31 of the spring is received within the U-shaped portion of the first stationary contact 15 and is in constant electrical connection with that contact.

The tangentially extending top end 32 of helical spring 30 extends to the left and is spring biased against the underside of the top horizontally extending arm 21 of the second stationary contact 18.

It is seen that in this normally closed contacts configuration a conduction path normally exists from terminal 16 of the first stationary contact 15 to the end 31 of spring 30 which is in contact with the U-shaped upper portion of contact 15. The conduction path passes through helical spring 30 to its top tangentially extending end 32 and then to the second stationary contact 18 and to its terminal 19.

A plunger guide post 36 located at the right rear portion of base 12 is an integrally molded part of the base and serves to maintain the plunger 40 in proper registration with base 12 and helical spring contact 30, as will be described.

Plunger 40 is a unitary molded plastic piece that has a cylindrical barrel portion 42 in sliding engagement with a circular bushing 44 in the top surface of a cover member 50. The bottom portion of cover member 50 is a hollow open-bottomed enclosure whose bottom edges are secured to the peripheral region of base 12.

The top 46 of plunger 40 is shaped to receive a push-on type of decorative actuator button. The bottom portion of plunger 40 has a radially extending stop 52 around at least a portion of its circumference. In the unactuated condition of the switch, spring contact 30 engages the bottom of plunger 40 and urges it upwardly so that stop 52 engages the underside of cover 50 to prevent the withdrawal of plunger 40 and to assure that spring end 32 engages contact 18.

Plunger 40 has a central shaft 56 that is coaxial with and radially spaced from barrel 42. Shaft 52 fits within hollow cylindrical post 25 and is in sliding engagement therewith. If more spring force is desired than can be provided by spring contact 30, an additional helical spring 58 may be inserted between the top of central shaft 56 and the top of post 25.

As best seen in FIG. 1, the bottom of molded plunger 40 includes two downwardly extending tabs or skirts 62 and 64 that are slightly spaced apart to form the vertically extending slot 66. Stop 52 includes the radially extending keyway 70 and the downwardly extending pusher tab 72. When plunger 40 is inserted onto center post 25 during assembly of the switch it is circumferentially rotated so that keyway 70 slidingly engages the sides of guide post 36 on base 12. This establishes circumferential registration of the plunger and base. Tabs 62 and 64 fit in the space between the left end of semicircular guide 26 and the left face of pie-shaped guide post 28. Slot 66 provides a clearance space for receiving end 32 of spring contact 30.

In the unactuated condition of the normally closed switch of FIG. 1, end 32 of spring 30 is in contact with the top of slot 66 and with the underside of arm 21 on stationary contact 18. When the switch is actuated by pressing downwardly on plunger 40, the top of slot 66 pushes down on end 32 of spring 30 and causes that end to become disengaged from horizontal arm 21 of contact 18. At the extreme limit of the downward movement of plunger 40, which is defined by the engagement of the bottom surface of stop 52 and the top surface of semicircular guide 26, the spring end 32 is in the void space between arms 21 and 22 of contact 18, thereby establishing an open condition for the switch. At this downward position of plunger 40 the downwardly extending pusher tab 72 engages spring end 31 and the contact 15. The frictional movement serves as a contact wiping action that tends to keep the respective contact regions relatively free of foreign matter.

When the downward force is removed from plunger 40, the energy stored in spring contact 30, and in spring 58 if it is used, raises the plunger to its uppermost position illustrated in FIG. 3 and brings end 32 of spring 30 back into engagement with the underside of arm 21 on stationary contact 18. This reestablishes the normally closed contacts condition of the switch.

FIG. 4 illustrates the simplicity with which the switch of this invention may be adapted to a normally open configuration. The switch is constructed substantially identically to the embodiment described above except that the tangentially extending top end 32' of spring contact 30' is formed with a double bend in it so that in the unactuated position of plunger 40 end 32' is in the void space between horizontal arms 21 and 22 of stationary contact 18. When plunger 40 is depressed, the top of slot 66, FIG. 1, engages end 32' of spring 30' and moves it downwardly into engagement with the lower arm 22 of stationary contact 18. It thus is seen that the basic switch has been transformed from a normally closed to a normally open configuration merely by substituting a spring contact 30 having a differently shaped end 32'.

FIG. 5 illustrates an alternative way of establishing a normally open configuration for the switch. The switch construction, including spring contact 30 is substantially the same as the normally closed embodiment illustrated in FIGS. 1–4. The only difference is in the shape of the second stationary contact 18'. Instead of having two horizontal arms as illustrated in FIG. 1, it has only one horizontal surface **18*a*. In the unactuated condition, end 32 of spring contact 30 is above and out of contact with surface 18*a* of contact 18'. When plunger 40 is depressed, the top of slot 66 forces end 32 of spring 30 downwardly into contact with surface 18*a* to close the electrical circuit between the stationary contacts. When the downward force is removed from plunger 40, spring contact 30 returns the plunger and spring end 32** to their uppermost positions.

The pretravel of the plunger before spring end 32 breaks or makes contact with stationary contact 18, and the overtravel that the plunger makes after spring end 32 breaks or makes contact with stationary contact 18 may be established by the shape of spring end 32. The shaping of the end of spring 30 is a relatively simple operation so that the pretravel and overtravel may be changed without any significant change in the design of the component parts of the switch.

As pointed out above, the switch may be made in either a normally closed contacts embodiment or a normally open contacts embodiment merely by substituting a differently shaped spring or a differently shaped second stationary contact 18.

While a preferred embodiment of the invention has been illustrated and described, it is to be understood that alterations and modifications may be made to the described embodiment without departing from the scope of the present invention.

What is claimed is:

1. A momentary push operated switch comprising a base member, first and second stationary contacts disposed in spaced relationship on said base member, a post extending upwardly from said base member, a helical spring member disposed about said post with its helical axis substantially normal to said base member.

first and second spring ends extending tangentially from respective opposite end regions of the helical body of the spring, said second stationary contact having at least one conductive surface for selectively contacting the second spring end, a plunger in sliding engagement with said post and adapted to engage the second spring end when the plunger is depressed onto said post, said first spring end engaging said first stationary contact, a cover member cooperating with said base member to enclose said contacts and said post, an aperture in said cover for guiding said plunger in a reciprocal motion toward and away from said post.

2. The combination claimed in claim 1 and further including a guide post extending upwardly from said base member, a keyway on said plunger for slidingly engaging said guide post to establish a desired circumferential relationship between the plunger and the base member means on said plunger for receiving said second spring end and for moving the second spring end toward said base member during movement of the plunger toward the base member.

3. The combination claimed in claim 2 and including stop means on said plunger for restricting the reciprocating movement of the plunger on said first named post between outer and inner limits.

4. The combination claimed in claim 3 wherein said second spring end is in engagement with said one conductive surface of the second stationary contact when the plunger is at its outer limit, said plunger moving the second spring end out of engagement with said one conductive surface of the second stationary contact when the plunger moves toward its inner limit.

5. The combination claimed in claim 3 wherein said second spring end is out of engagement with said one conductive surface of the second stationary contact when the plunger is at its outer limit, said plunger moving the second spring end into engagement with said one conductive surface of the second stationary contact when the plunger moves toward its inner limit.

6. The combination claimed in claims 4 or 5 and including means on said plunger for urging the first spring end into engagement with the first stationary contact when the plunger is at its inner limit, thereby to induce a wiping action between the first spring end and the first stationary contact.

7. The combination claimed in claims 4 or 5 and including second guide means on said base for engaging the first spring end to limit the rotational movement of the helical spring member about said post.

8. A push operated momentary switch comprising a base member having a substantially planar surface, a first stationary contact on said surface and having a U-shaped contact surface extending upwardly from the surface, a second stationary contact on said surface and having at least one conductive surface extending substantially parallel to the surface, a first post extending upwardly from said surface at a region adjacent said two stationary contacts, a helical spring contact disposed over said post with its helical axis substantially perpendicular to said surface, said spring contact having first and second spring ends that extend tangentially in opposite directions from opposite ends of the helical body of the spring, the first spring end being received in the U-shaped contact surface of said first stationary contact and the second spring end being adapted to engage said conductive surface on the second stationary contact, a guide post extending upwardly from said surface and substantially parallel to the first post, a plunger adapted to fit over said first post and to engage the top end of the spring contact thereon, said plunger being adapted to move downwardly on said first post to compress said spring contact, a keyway on said plunger for slidingly engaging said guide post on the base for establishing a desired circumferential registration of the plunger relative to the base and stationary contacts, means on said plunger for engaging said second spring end of the spring contact and for pushing said second spring end toward said base when the plunger is pushed toward the base, cover means cooperating with said base for enclosing said contacts and posts and for providing a bushing that permits the plunger to extend therethrough and to reciprocate with respect thereto, and means for restricting the reciprocating motion of the plunger between outermost and innermost positions on said first post.

9. The switch claimed in claim 8 wherein the second spring end is in engagement with the conductive surface of the second stationary contact when the plunger is in its outermost position on said first post, and engagement between the second spring end and the second stationary contact is broken when the plunger is moved a predetermined distance toward said base.

10. The switch claimed in claim 8 wherein the second spring end is out of engagement with the conductive surface of the second stationary contact when the plunger is in its outermost position on said first post, and engagement between the second spring end of the second stationary contact is established when the plunger is moved a predetermined distance toward said base.

11. The combination claimed in claim 1 and further including a recess in said plunger extending in the direction of movement of the plunger, a second helical spring separate from the first named helical spring member, said second helical spring being disposed in said recess to yielding urge the plunger outwardly from the base member.

12. A momentary push operated switch comprising a base member, first and second stationary contacts disposed in spaced relationship on said base member, a post extending upwardly from said base member, a helical spring member disposed about said post with its helical axis substantially normal to said base member, first and second spring ends extending tangentially from respective opposite end regions of the helical body of the spring, said second stationary contact having at least one conductive surface for selectively contacting the second spring end, a plunger in sliding engagement with said post and adapted to engage the second spring end when the plunger is depressed onto said post, said first spring end engaging said first stationary contact, a cover member cooperating with said base member to enclose said contacts and said post, an aperture in said cover for guiding said plunger in a reciprocal motion toward and away from said post, guide means in addition to said cover member extending upwardly from said base member, means on said plunger cooperating with said guide means for establishing a desired circumferential relationship between the plunger and base member.

13. The combination claimed in claim 12 wherein said guide means is a post that is separate from the first named post.

14. The combination claimed in claims 12 or 13 and further including a second spring separate from said first spring member, means for retaining said second spring in engagement with said first post and said plunger for yieldingly maintaining said plunger in its outermost position on said first post in the absence of a force being applied to the plunger.

15. The combination claimed in claim 14 wherein said plunger has a recess therein for receiving said second spring, said recess extending in the direction of movement of the plunger.

* * * * *